US005499820A

United States Patent [19]

Albertsson

[11] Patent Number: 5,499,820

[45] Date of Patent: Mar. 19, 1996

[54] GOLF SWING TRAINING DEVICE AND METHOD

[76] Inventor: Peter S. Albertsson, R.R. 1, Box 1821, Pawlet, Vt. 05761

[21] Appl. No.: 487,510

[22] Filed: Jun. 7, 1995

[51] Int. Cl.[6] ..... A63B 69/36

[52] U.S. Cl. ..... 273/189 A; 128/879; 273/DIG. 30

[58] Field of Search ..... 273/189 A, 187.2, 273/DIG. 30; 473/61, 62; 128/879

[56] References Cited

U.S. PATENT DOCUMENTS

| | | | |
|---|---|---|---|
| D. 234,434 | 3/1975 | Trevino | D34/5 |
| D. 266,345 | 9/1983 | Bigham et al. | D21/234 |
| D. 274,386 | 6/1984 | Tanaka | D2/361 |
| D. 329,678 | 9/1992 | Mehrholz | D21/234 |
| 1,418,637 | 6/1922 | Flood | 273/189 A |
| 1,469,315 | 10/1923 | Hansard | 273/189 A |
| 2,794,638 | 6/1957 | Risher et al. | 273/54 |
| 3,235,258 | 2/1966 | Stroburg | 273/54 |
| 3,408,077 | 10/1968 | Norwood | 273/189 |
| 3,423,095 | 1/1969 | Cox | 273/189 |
| 3,606,342 | 9/1971 | Albertson, Jr. | 273/189 R |
| 4,241,922 | 12/1980 | Elliott, Jr. | 273/189 A |
| 4,292,963 | 10/1981 | Ford | 128/87 R |
| 4,451,044 | 4/1984 | Elliott | 273/189 A |
| 4,768,502 | 9/1988 | Lee | 128/87 R |
| 4,798,199 | 1/1989 | Hubbard et al. | 128/87 R |
| 4,925,187 | 5/1990 | Fleenor et al. | 273/54 B |
| 4,941,460 | 7/1990 | Working | 128/77 |
| 5,207,430 | 5/1993 | Goins | 273/189 R |
| 5,295,948 | 3/1994 | Gray | 602/5 |
| 5,425,539 | 6/1995 | Steffes | 273/189 A |

*Primary Examiner*—George J. Marlo
*Attorney, Agent, or Firm*—Fisher, Christen & Sabol

[57] ABSTRACT

A device worn by a golf player around his following hand, wrist and lower forearm to aid in the proper hand placement for a proper golf swing. When worn, the device positions the following hand to promote a following club or racquet swing, yet allows the release of the following wrist. The golf swing trainer includes a rigid brace which has an inner side and an outer side and three straps attached to the outer surface of the rigid brace. The rigid brace is contoured so that a golfer's following hand is in the angle which is created when a golf club is swung with the club head following the turning body. The first and third straps are made of a non-resilient material and the second strap, which is in between the first strap and the third strap, is made of a resilient material.

14 Claims, 4 Drawing Sheets

GOLF SWING TRAINING DEVICE AND METHOD

BACKGROUND OF THE INVENTION

1. Field Of The Invention

The invention relates to a golf training aid and, in particular, to a golf swing trainer. That is, the invention is a device worn by a player on the back side of his hand (including his index finger), wrist and lower forearm which aids in the proper placement of his hand and wrist for a proper golf swing.

2. Description Of Related Art

Prior art golf swing trainers include the device which is illustrated in FIG. 1 of this application. The device of FIG. 1 includes a rigid or substantially rigid plastic brace which is molded so that a golfer's following hand (i.e., the right hand for a right handed golfer or the left for a left handed golfer) is in the angle which is created when the golf club is swung with the club head following the turning body. While making a golf stroke in this position, the driving power is applied in a straight line, in the direction of the desired line of flight. So-called "sliced strokes" and "short balls" are, thus, prevented to a substantial extent. It should be noted that it is common for a golfer to collapse his wrist in a backwards direction while swinging his golf club, which results in a line of driving power which is not straight. However, although the prior art device illustrated in FIG. 1 remedies this problem, when a golfer wears the device shown in FIG. 1, his index finger, hand, wrist and lower forearm are fixed in this position (by means of non-resilient or non-elastic straps 52 and 53 positioned as shown in FIG. 1).

Other golf training aids include those disclosed and claimed in U.S. Design Pat. No. 234,434 (Trevino), U.S. Design Pat. No. 266,345 (Bigham et al.), U.S. Design Pat. No. 329,678 (Mehrholz), U.S. Pat. No. 1,418,637 (Flood), U.S. Pat. No. 1,469,315 (Hansard), U.S. Pat. No. 3,408,077 (Norwood), U.S. Pat. No. 3,423,095 (Cox), U.S. Pat. No. 3,606,342 (Albertson, Jr.) and U.S. Pat. No. 4,241,922 (Elliott, Jr.). Other wrist support devices (for, for example, bowling or therapeutic purposes) include those disclosed and claimed in U.S. Design Pat. No. 274,386 (Tanaka), U.S. Pat. No. 2,794,638 (Risher et al.), U.S. Pat. No. 3,235,258 (Stroburg), U.S. Pat. No. 4,292,963 (Ford), U.S. Pat. No. 4,768,502 (Lee), U.S. Pat. No. 4,941,460 (Working), U.S. Pat. No. 4,925,187 (Fleenor et al.) and U.S. Pat. No. 5,295,948 (Gray).

BROAD DESCRIPTION OF THE INVENTION

An object of the invention is to overcome the disadvantages and problems of the prior art golf swing trainers, including, in particular, those of the prior art golf swing trainer which is illustrated in FIG. 1. For example, an object of the invention is to have a golf swing trainer which prevents the backward collapse of a golfer's wrist during a golf swing, while still allowing for some mobility of the golfer's wrist at its bend point. Other objects and advantages of the invention are set out herein or are obvious herefrom to one skilled in the art.

The objects and advantages of the invention are achieved by the golf swing trainer of the invention.

The invention includes a brace which is attached to the top or back surface of a golfer's hand, wrist and forearm and which is contoured so that a golfer's following hand is in the angle which is created when the golf club is swung with the club head following the turning body. When worn, the device positions the following hand to promote a following club or racquet swing, yet allows the release of the following wrist.

Attached to the brace may be padding and an outer layer of material over this padding. The padding may make the brace more comfortable to wear.

Three straps hold the player's hand, wrist and lower forearm against the brace. The first strap encircles the golfer's index finger or forefinger on his following hand. This strap is not made of resilient material. The third strap encircles the player's lower forearm above his wrist. This strap is made of a strechable, resilient material, so that some movement of the player's wrist at its band point is possible. The second strap encircles the golfer's forearm directly above the bend point on his wrist. This strap is positioned between the other two straps. All of the three straps are attached to the back of the brace.

The invention device addresses and substantially solves the problem of a golfer collapsing his wrist in a backwards direction while swinging his golf club, which results in a line of driving power which is not straight. Both the device illustrated in FIG. 1 and the subject invention remedy this problem. However, when a golfer wears the device shown in FIG. 1, his index finger, hand, wrist and lower forearm are fixed in this position. This position should not be completely fixed in the golf swing. Some movement of the following wrist is necessary for full swings. In contrast, in the instant invention, the first (back) strap is made of resilient material and, thus, allows for a bending point in a golfer's wrist. The first (back) strap stretches so a golfer can release.

The instant invention may be used by either right handed or left handed players. If the player is right handed, the brace is secured to the golfer's left index finger, hand, wrist and lower forearm. Similarly, if the player is left handed, the brace is secured to the golfer's right index finger, hand, wrist and lower forearm. The brace shown in FIGS. 2 to 8 is to be used by right handed players. The brace which is to be used by left handed players is a mirror image of the brace to be used by right handed players. In all other respects, the right-handed brace and the left handed braces are identical to one another.

Modifications and changes made to the golf swing trainer can be effected without departing from the scope or spirit of the present invention. For example, the rigid, molded base could be made of metal, as opposed to being made of a hard plastic. Also, the embodiments of this golf swing trainer which are illustrated as follows have been shown only by way of example and should not be taken to limit the scope of the following claims.

DETAILED DESCRIPTION OF THE INVENTION

A rigid brace (51) is contoured to mattingly engage the golfer's index finger, hand, wrist and lower forearm. The brace (51) is anatomically shaped to fit the contours of the golfer's extended index finger, hand, wrist and lower forearm while these body parts are positioned at the proper angle which is created when a golf club is swung with the club head following the turning body. While making a golf stroke in this position, the driving power is applied in a straight line, in the direction of the desired line of flight. While wearing the brace, the golfer is unable to collapse his wrist in a backwards direction. So-called "sliced strokes" and "short balls" are, thus, prevented.

Figure 1:
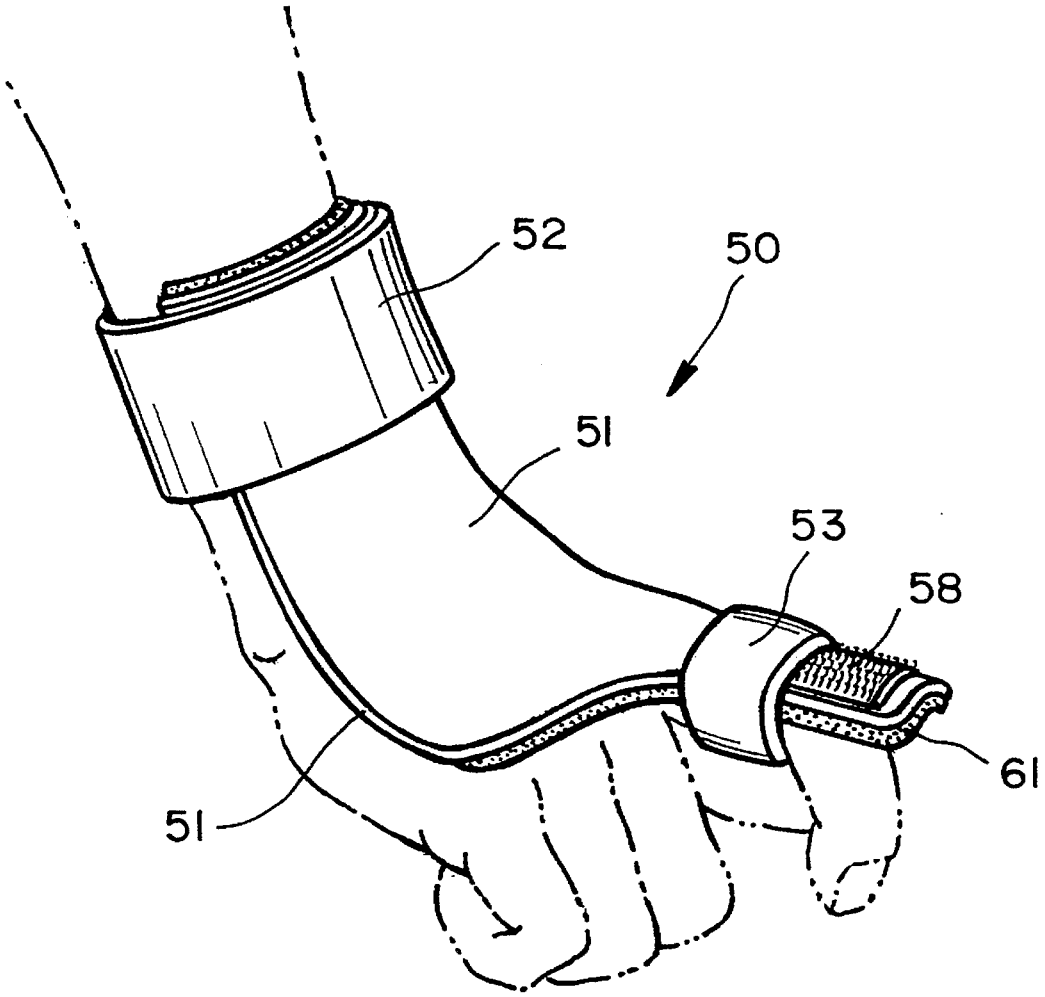
FIG. 1 (PRIOR ART)
FIG. 1 is a perspective view of the prior art golf training aid positioned on a person's hand and lower forearm.
Figure 2:
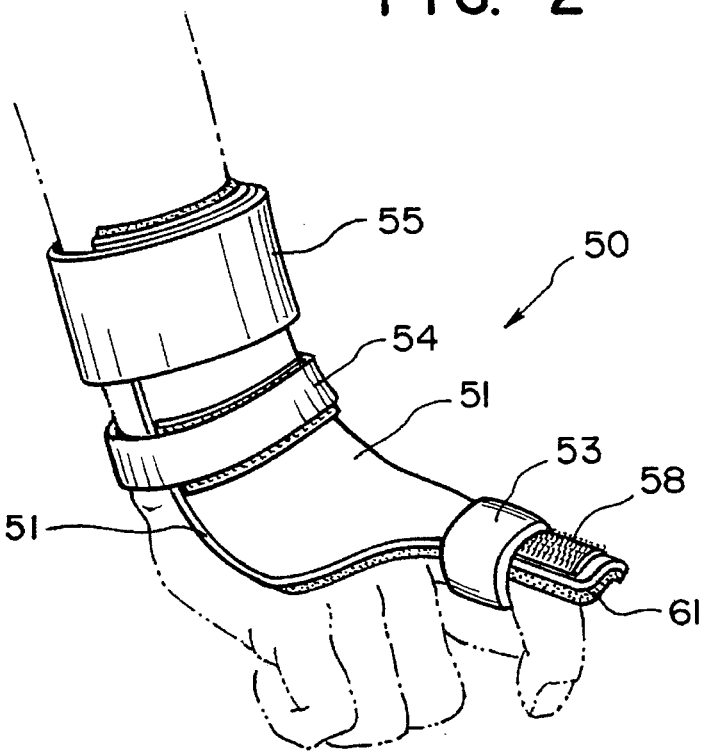
FIG. 2 is a perspective view of the improved golf training aid positioned on a person's hand and lower forearm.
Figure 3:
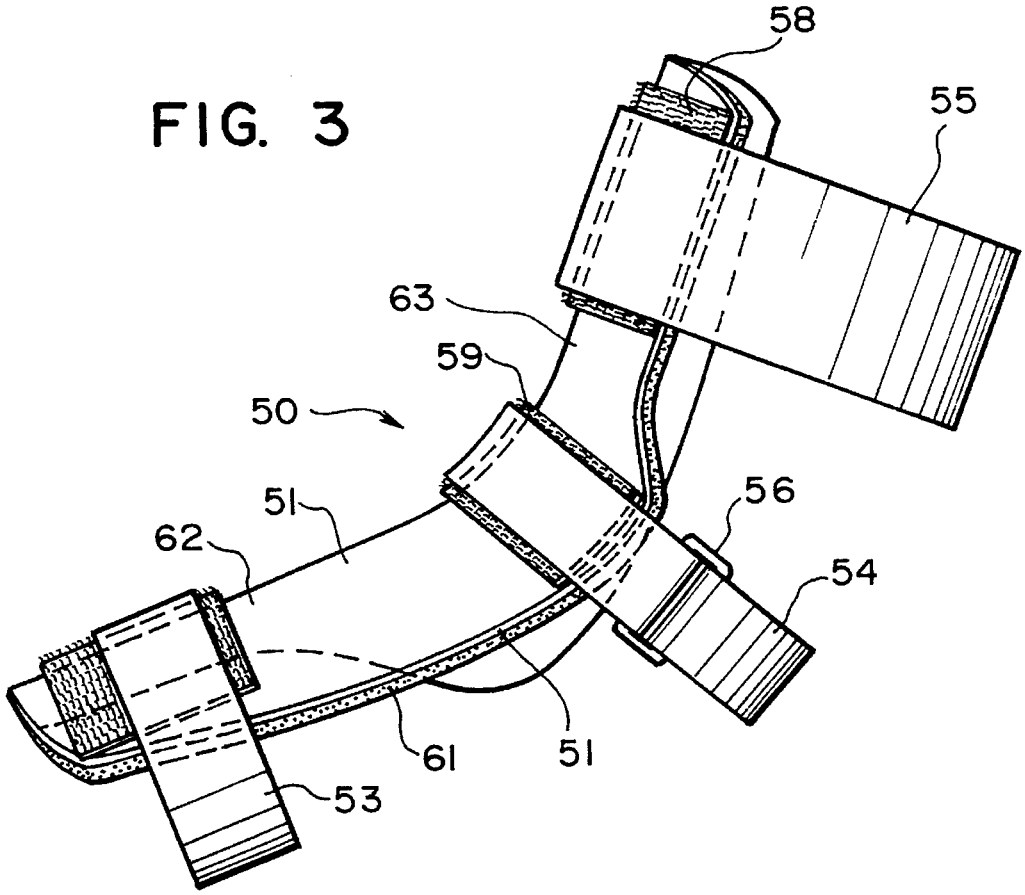
FIG. 3 is a left side view of the improved golf training aid including the three straps positioned thereon.
Figure 8:
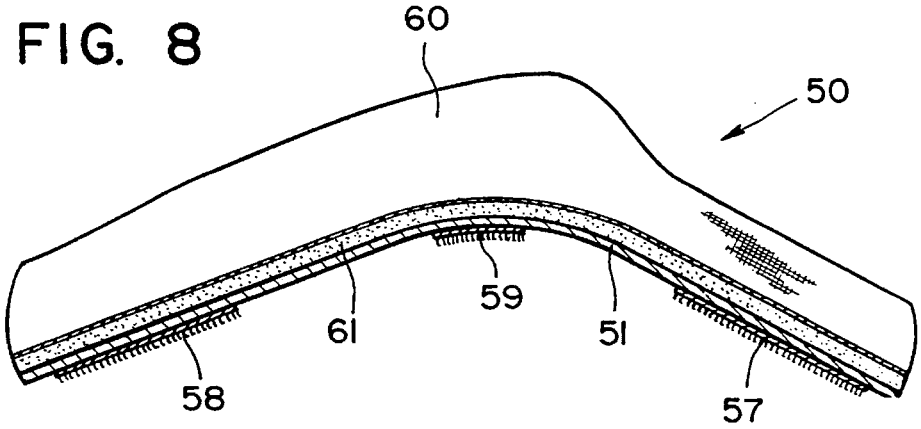
FIG. 8 is a left side view in elevation of the brace in inverted position without the straps attached thereto.

When the brace (51) is in place, the hand is bent at an upward angle in relation to the longitudinal axis of the forearm. Or, in other words, the portion (62) of the brace (51) which fits against the hand is at an angle to the longitudinal axis of the portion (63) of the brace (51) which fits against the lower forearm. This angle is usually between about 35 and 55 degrees, preferably between about 40 and about 50 degrees and most preferably about 45 degrees. The positioning of the brace (51) on the hand and the angle is best seen in FIG. 2. The angle of the front portion (62) to the back portion (63) of the brace 951) is best seen in FIGS. 3 and 8.

Figure 4:
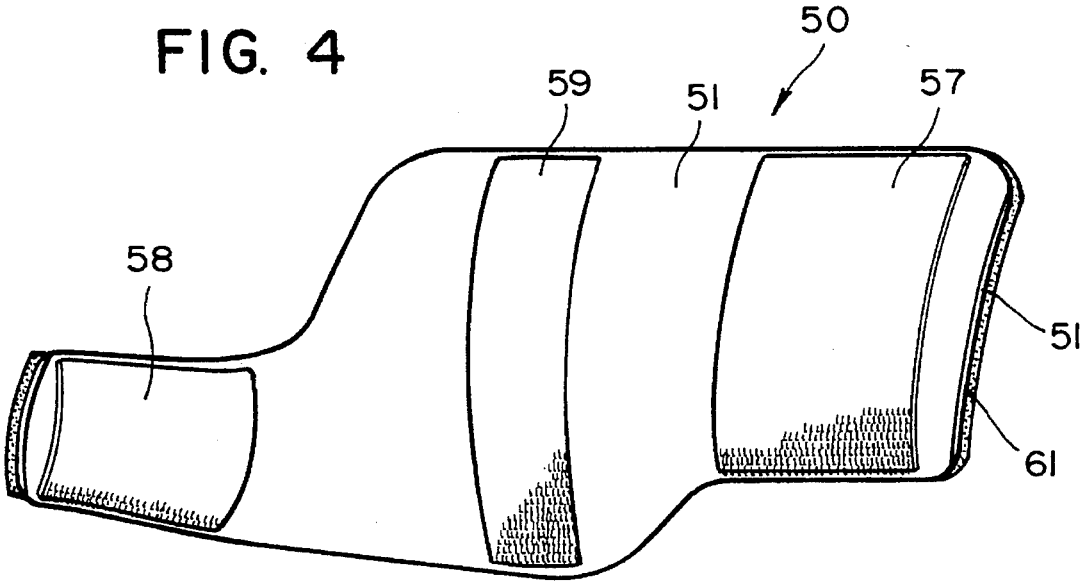
FIG. 4 is a top plan view of the back of the brace including the three patches of material sold under the trademark VELCRO or other similar material.
Figure 9:
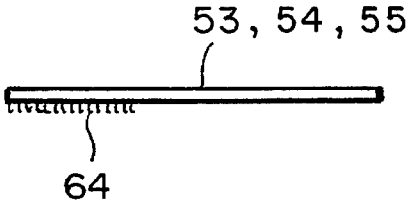
FIG. 9 is a side view of one of the straps having loop and hook or similar attachment means.
Figure 5:
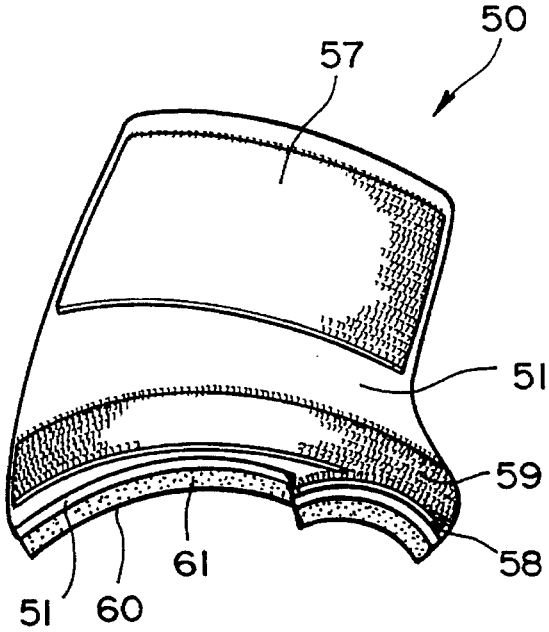
FIG. 5 is a front view in elevation of the back of the brace including the three patches of material sold under the trademark VELCRO or other similar material.
Figure 6:
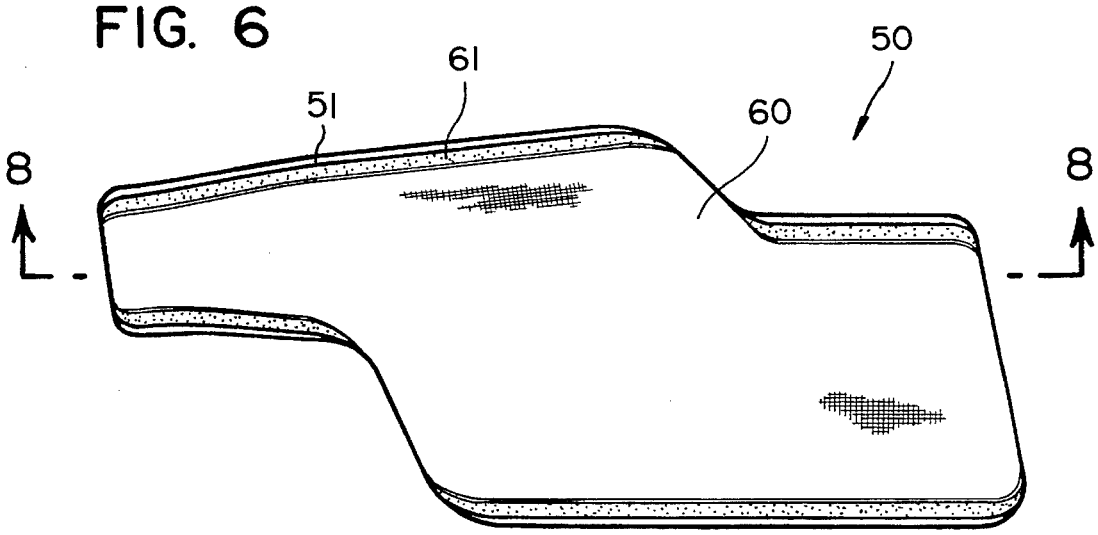
FIG. 6 is a bottom plan view of the top portion of the brace including the padding positioned thereon.
Figure 7:
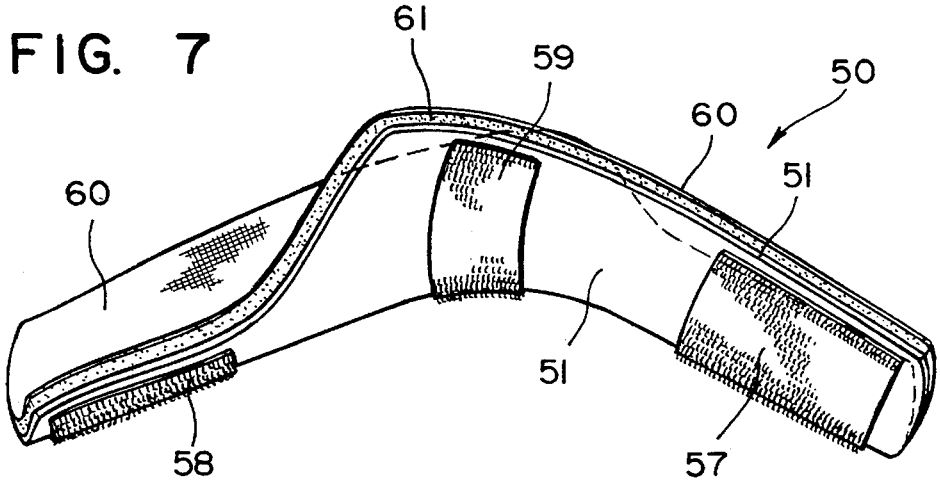
FIG. 7 is a right side view in elevation of the brace in inverted position without the straps attached thereto.

The brace (51) may be made of any appropriate, rigid (or substantially rigid) material which can be formed in the desired shape, and is preferably made of a hard, lightweight plastic. It is convenient to make brace (51) by injection molding. The part of the brace (51) against which the golfer's index finger (of his following hand) rests is best wider than and preferably about twice as wide as his index finger. The part (62) of the brace (51) against which the back of the golfer's hand rests is preferably about as wide as is the back of his hand. The part of the brace (51) against which the back of the golfer's wrist rests and lower end of the forearm fits is about the same thickness as part (62). Thus, the middle portion of the brace (51) is wider than is the portion of the brace (51) against which the golfer's index fingers rests. The part (63) of the brace (51) narrows down to a form which correlates to the top of the lower forearm, and has the same width as the lower portion of the forearm. The top outline of the brace (51) is best seen in FIG. 4.

Transverse cross-sections of the brace (51) shows the top surface thereof is convex and the bottom surface thereof is concave.

A padding (61) preferably is attached (bonded) to and extends along the length of bottom surface of the brace (51) to cushion and support the golfer's index finger, hand, wrist and lower forearm. The padding (61) may be made of foam rubber (preferred) or of some other comfortable and appropriate material—foamed neoprene is preferred. An outer layer (60) of material (preferably woven cloth) may be attached (bonded) to the layer of padding (61)—the outer layer (60) is preferably a woven nylon material.

Attachment means (53, 54 and 56) are provided for holding the brace (51) against the index finger, hand, wrist and lower forearm of the golfer's following arm. These means are shown as three straps (53, 54 and 55) attached to the top of brace (51), that is, on the opposite side from where the padding (61) is attached. The attachment scheme preferably uses the conventional loop and hook material scheme. The attachment strips (57, 58 and 59) are affixed (bonded) transverse across the top surface of the brace (51). The attachment strips (57, 58, 59) are hook materials, such as, that sold under the trademark VELCRO. The straps (53, 54 and 55) are a woven pile fabric or a loop fabric (on both sides) whereby the center portion of each of the attachment straps (53, 54 and 55) is detachably affixed to the hook material comprising the strips (57, 58 and 59). The third strap (55) is attached to the top side of the brace (51) opposite to where the lower forearm of the golfer rests. The third strap preferably is made of resilient material such as a woven fabric composed of resilient or eleastic polymeric fiber. One end of strap (55) is made of a hook material (e.g., the material sold under the trademark VELCRO), or it may be made of other suitable material, so that the two ends of the strap may be detachably affixed to one another to form a loop. A buckle (not shown) may be attached to one end of the third strap (55) whereby the detachable affixing is done by looping through the buckle and then back on itself (loop and hook material attachment). The first strap (53) is attached to the top side of the brace (51) opposite to where the golfer's index finger rests. The first strap (53) is not made of resilient material. The first strap (52) is a shorter and narrower version of the third strap (55), and uses the same loop and hook (e.g., VELCRO) material scheme to form a loop to go around the index finger. The second strap (54) is attached to the top side of the brace (51), opposite to the area of the padding (61) upon which the golfer's forearm, just before the wrist. A buckle (56) is preferably attached to the end of the second strap (54). One end of strap (54) is made of a hook material (e.g., VELCRO) so that such end of the strap (54) can be looped through the buckle (56) and then back on itself for loop and hook detachable affixing. Each of the straps may be releasably attached to a strip of material sold under the trademark VELCRO or other resilient, contact fastening material attached to the brace (51) on the opposite side from where the padding (61) is attached.

Usually the index finger is inserted through the first strap (53), which is in looped form. Then the third strap (55) is put into place and looped around the lower forearm. The first strap (53) is then tightened. Then the second strap (54) is put into place and looped around the lower forearm just before the wrist. Any other sequence can be used, of course, to attach the brace (51) for use by a golfer.

The instant invention may be used by either right handed or left handed players. If the player is left handed, the brace is secured to the golfer's left index finger, hand, wrist and lower forearm. Similarly, if the player is right handed, the brace is secured to the golfer's right pointer finger, hand, wrist and lower forearm. The brace shown in FIGS. 2 to 8 is to be used by right handed players. The brace which is to be used by left handed players is a mirror image of the brace to be used by right handed players. In all other respects, the right-handed brace and the left handed braces are identical to one another.

LIST OF PARTS NUMBERS

In connection with the figures, the following list of the names of the parts of the instant invention are noted:

| | |
|---|---|
| 50 | golf swing trainer; |
| 51 | rigid brace; |
| 52 | third strap on prior art device; |
| 53 | first strap; |
| 54 | second strap; |
| 55 | flexible third strap on invention device; |
| 56 | buckle on second strap; |
| 57 | VELCRO patch upon which first strap is attached; |
| 58 | VELCRO patch upon which second strap is attached; |
| 59 | VELCRO patch upon which third strap is attached; |
| 60 | outer layer; |
| 61 | padding beneath outer layer; |
| 62 | front portion of rigid brace; |
| 63 | back portion of rigid brace; |
| 64 | VELCRO patch on end of first or third straps. |

What is claimed is:

1. A golf swing trainer, which comprises:

(a) a rigid or substantially rigid brace having an inner side and an outer side, said inside of said brace being adapted to conform to the top surface of a hand, a wrist and the lower portion of a forearm when the wrist is flexed upwardly;

(b) a first strap attached to the outer surface of said brace, said first strap being adapted to circumscribe the index finger of the hand;

(c) a second strap attached to the outer surface of said brace, said second strap being adapted to circumscribe the forearm immediately next to the wrist; and (d) a third strap attached to the outer surface of said brace, said third strap being adapted to circumscribe the lower forearm above the second strap.

2. A golf swing trainer as claimed in claim 1, wherein the first strap and the second strap are each comprised of a non-resilient material, and the third strap is comprised of a resilient material.

3. A golf swing trainer as claimed in claim 1, wherein the said brace is contoured so that a golfer's following hand is in the angle which is created when a golf club is swung with the club head following the turning body.

4. A golf swing trainer as claimed in claim 1, further comprising padding having an inner side and an outer side, the outer side of the padding being attached to the inner side of said brace.

5. A golf swing trainer as claimed in claim 4, wherein the padding between the outer layer and the rigid brace is made of foam rubber.

6. A golf swing trainer as claimed in claim 1, further comprising a thin outer layer of material attached to the inner side of the padding.

7. A golf swing trainer as claimed in claim 1, further comprising a buckle attached to the second strap.

8. A golf swing trainer as claimed in claim 1, wherein the first strap is attached to the outer surface of said brace at one of its ends, the third strap is attached to the outer surface of said brace at its opposite end, and the second strap is attached to the outer surface of said brace between the first strap and the second strap.

9. A golf swing trainer as claimed in claim 1, wherein the first strap, the second strap and the third strap are releasably attached to the outer surface of said brace.

10. A golf swing trainer as claimed in claim 1, wherein said brace is made of a hard plastic.

11. A golf swing trainer as claimed in claim 1, including mating, overlapping portions of two ends of the first strap, the second strap and the third strap which are comprised, at least in part of hook material in a loop (pile) and hook arrangement so that the two ends of each strap may be easily and detachably attached to one another.

12. A golf swing trainer as claimed in claim 1, wherein the third strap is comprised, at least in part, of an elastic material.

13. A golf swing trainer as claimed in claim 1, including patches upon which the first strap, the second strap and the third strap are attached to the outer side of the brace are comprised of hook material.

14. A method for training a person to swing a golf club, comprising using the golf swing trainer of claim 1 while swinging a golf club.

* * * * *